US005226590A

United States Patent [19]

Davis

[11] Patent Number: 5,226,590

[45] Date of Patent: Jul. 13, 1993

[54] ADAPTOR FOR MOUNTING TEMPERATURE SENSITIVE DUTY CYCLING CONTROL WITH FLEXIBLE DUCT WORK

[75] Inventor: Raymond K. Davis, 1616B Burlington Pike, Suite 2, Florence, Ky. 41042

[73] Assignee: Raymond K. Davis, Florence, Ky.

[21] Appl. No.: 821,092

[22] Filed: Jan. 15, 1992

[51] Int. Cl.[5] ..... F24C 3/02

[52] U.S. Cl. ..... 236/10; 62/229; 62/231; 236/46 R; 126/89

[58] Field of Search ..... 165/40; 236/10, 11, 236/1 G; 62/229, 231; 126/89

[56] References Cited

U.S. PATENT DOCUMENTS 1,773,585 8/1930 Klockau ..... 236/1 G
4,191,326 3/1980 Diermayer et al. ..... 236/1 G
4,384,671 5/1983 Hayes ..... 236/1 G
4,470,267 9/1984 Davis et al. ..... 236/46 R
4,664,311 5/1987 Welch .
4,712,733 12/1987 Davis .
4,777,929 10/1988 Welch .

*Primary Examiner*—John K. Ford
*Attorney, Agent, or Firm*—Wood, Herron & Evans

[57] ABSTRACT

An adaptor is designed to mount a duty cycling control switch for a furnace or air conditioning system which has flexible duct work. The adaptor includes two opposite cylindrical sections with a central section which includes an arcuate portion and a planar rectangular portion. The planar rectangular portion is tangential to the surfaces of the first and second cylindrical sections. The duty cycling control switch is mounted to this planar portion. Thus, air passing through the duct work will pass through this adaptor altering the temperature of the rectangular plate, thus, altering the temperature of the duty cycling switch causing it to activate.

8 Claims, 2 Drawing Sheets

ADAPTOR FOR MOUNTING TEMPERATURE SENSITIVE DUTY CYCLING CONTROL WITH FLEXIBLE DUCT WORK

BACKGROUND OF THE INVENTION

Heating systems and air conditioning systems are generally operable in response to a thermostat. Thermostats open or close in response to the surrounding temperature and act to maintain the heating and air conditioning system in operation until a preset temperature is reached. Both heating and air conditioning systems operate efficiently only for a short period of time. In a furnace, the temperature of the heat exchanger increases as fuel burns. Eventually, the heat exchanger surface in contact with the fire box becomes so hot that the heated air is forced from the fire box through the chimney without raising the temperature of the heat exchanger and thus energy is wasted.

For this reason, it is preferable to periodically shut down the burner while air is forced through the heat exchanger causing the surface to cool down. This permits the heat from the fire box to efficiently transfer heat to the heat exchanger.

With an air conditioning system, the compressor operates and causes coils within the plenum to cool to a minimum of 34° C. Even though the coils are at their minimum temperature, the compressor continues to operate using energy, but without value.

Various duty cycling switches have been employed in the past such as those disclosed in Kinsey U.S. Pat. No. 3,136,730, Hamilton U.S. Pat. No. 3,921,899, Brown U.S. Pat. No. 4,534,181. These switches generally detect temperature within the plenum. This temperature changes extremely quickly and responds to minor changes. Thus, it is not a reliable way to control a furnace or air conditioner.

A duty cycling control switch disclosed in Davis et al U.S. Pat. No. 4,470,267 is specifically designed to retrofit existing units. It is designed to mount to the exterior wall of a furnace or air conditioning plenum and opens and closes in response to changing temperatures of the plenum wall and heating system. The switch can be adjusted to deactivate under desired conditions. More particularly, the switch is a bimetal duty cycling switch which is enclosed within a case wherein the base of the case is metal. The bimetal switch is in thermal contact with the metal base plate which in turn contacts the plenum wall. This switch, when mounted to the plenum, has been found to efficiently duty cycle air-conditioners and furnaces.

Unfortunately, the plenum is not always accessible. Therefore, in these situations the switch must be mounted on a heat duct which is accessible. Much newer construction has eliminated metal duct work. This has been replaced with flexible cylindrical duct work which is formed from plastic reinforced with a spiral wire. Since this is plastic, which is a poor heat conductor, one cannot attach a duty cycling switch to its exterior and accurately control the furnace or air conditioner. Until now if the plenum was not accessible and the ducts were flexible plastic, one could not attach a heat sensitive duty cycling switch to the HVAC unit.

SUMMARY OF THE INVENTION

The present invention is premised on the realization that an adaptor suitable for fixing a duty cycling control switch of the type disclosed in Davis U.S. Pat. No. 4,470,267 to flexible duct work incorporates a first and second cylindrical sections with a noncylindrical section between the two. The noncylindrical section includes a flat planar portion and an arcuate portion. The three sections form a continuous piece of duct work. The flat planar portion is a metal sheet which lies tangential to the surface of the first and second cylindrical sections.

In accordance with the present invention, a duty cycling control switch can be mounted to this planar section to accurately control the operation of a heating or air conditioning system.

This adaptor provides for an even flow of air through the adaptor over the planar surface upon which the duty cycling control switch is mounted. This provides for even heat transfer through the metal plate and through the duty cycling control switch. Accordingly, the unit functions as well as it would attached to a flat wall of the plenum of an air conditioning or heating system.

The objects and advantages of the present invention will be further appreciated in light of the following detailed description and the drawings in which:

DETAILED DESCRIPTION

Figure 1:
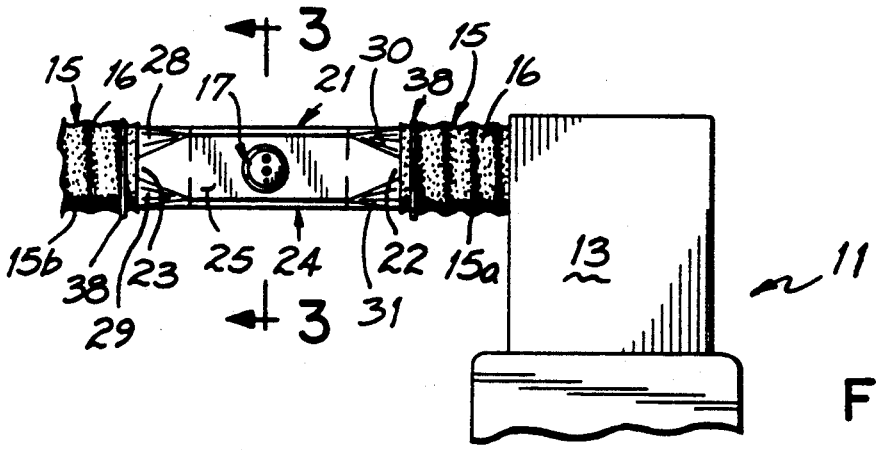
FIG. 1 is a diagrammatic view of a heating or air conditioning system incorporating the present invention.

As shown in FIG. 1, there is a heating/air-conditioning unit 11 which includes a heat exchanger (not shown) and a plenum 13. Extending from the plenum 13 is duct work 15. Duty cycling control switch 17 acts to turn the burner or compressor (not shown) of unit 11 on and off, as described below.

The duct work as exemplified by duct 15 is cylindrical having a plastic outer skin 16 which is spiral reinforced with wire (not shown).

Figure 2:
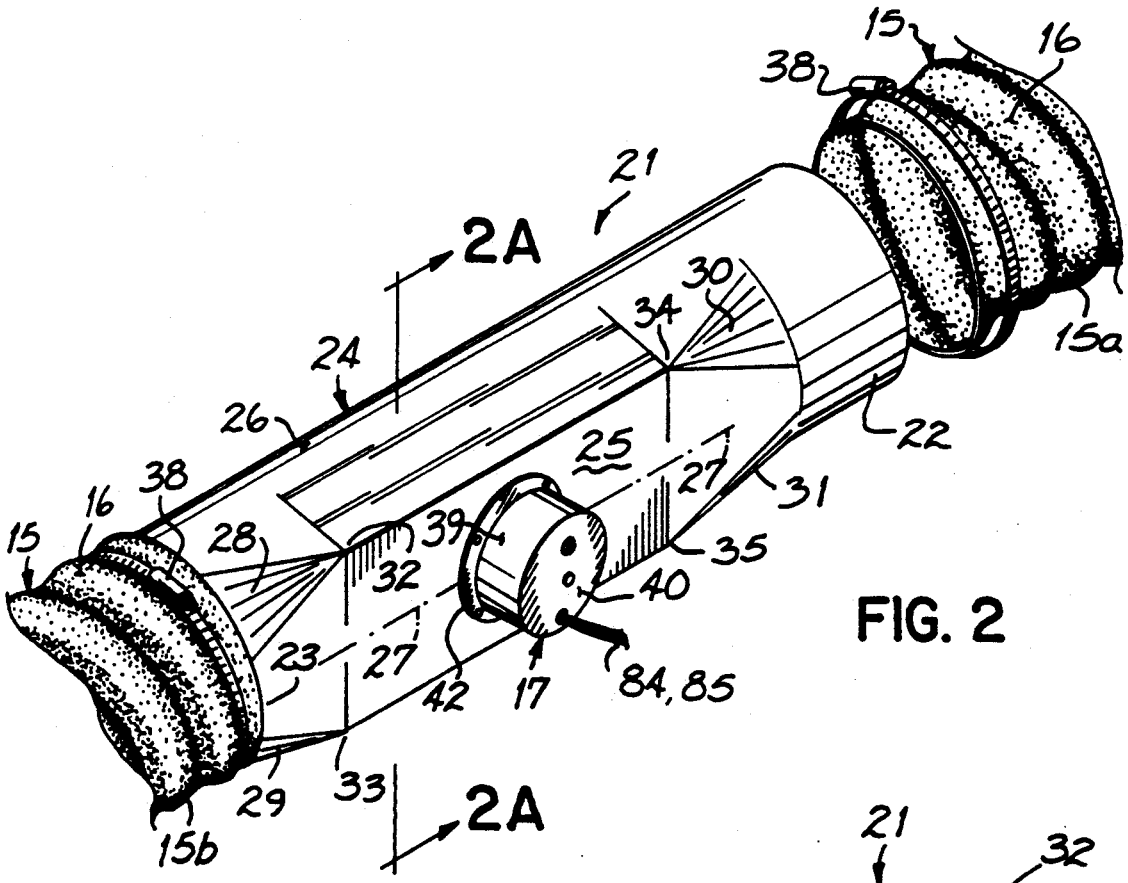
FIG. 2 is a perspective view of the adaptor of the present invention.
Figure 2A:
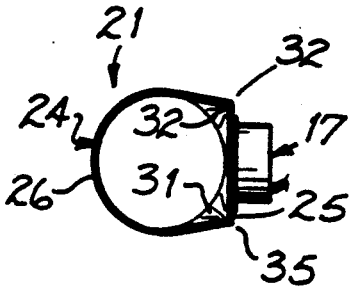
FIG. 2*a* is a cross-sectional view taken on line 2A—2A of FIG. 2.

As shown in FIG. 2, the duct 15 connects to an adaptor 21. Adaptor 21 includes a first cylindrical portion 22 and a second cylindrical portion 23 with a middle portion 24 connecting the two cylindrical portions. This middle portion 24 includes a rectangular planar portion 25 and an arcuate portion 26. As shown by phantom line 27, this planar portion 25 lies tangential to the surface of the first and second cylindrical sections 22,23. To form a complete, sealed conduit through the adaptor 21, there are also triangular sloped portions 28, 29, 30 and 31 which extend from the cylindrical portions to the corners 32, 33, 34 and 35, respectively of planar portion 25.

Portions 15*a*, 15*b* of duct work 15 slip over the first and second cylindrical portions 22 and 23 of adaptor 21 and are clamped in position with a worm gear band clamp 38. Other suitable wire clamps could also be used.

The duty cycling control 17 is secured to the rectangular planar portion 25 of adapter 21 with sheet metal screws. The duty cycling control 17 could be any temperature sensitive switch which closes on rise or on being heated. Preferably it is an adjustable temperature sensitive switch which permits adjustment of the switch to a particular unit. The preferred switch is that disclosed in U.S. Pat. No. 4,470,267 the disclosure of which is incorporated herein by reference.

Figure 3:
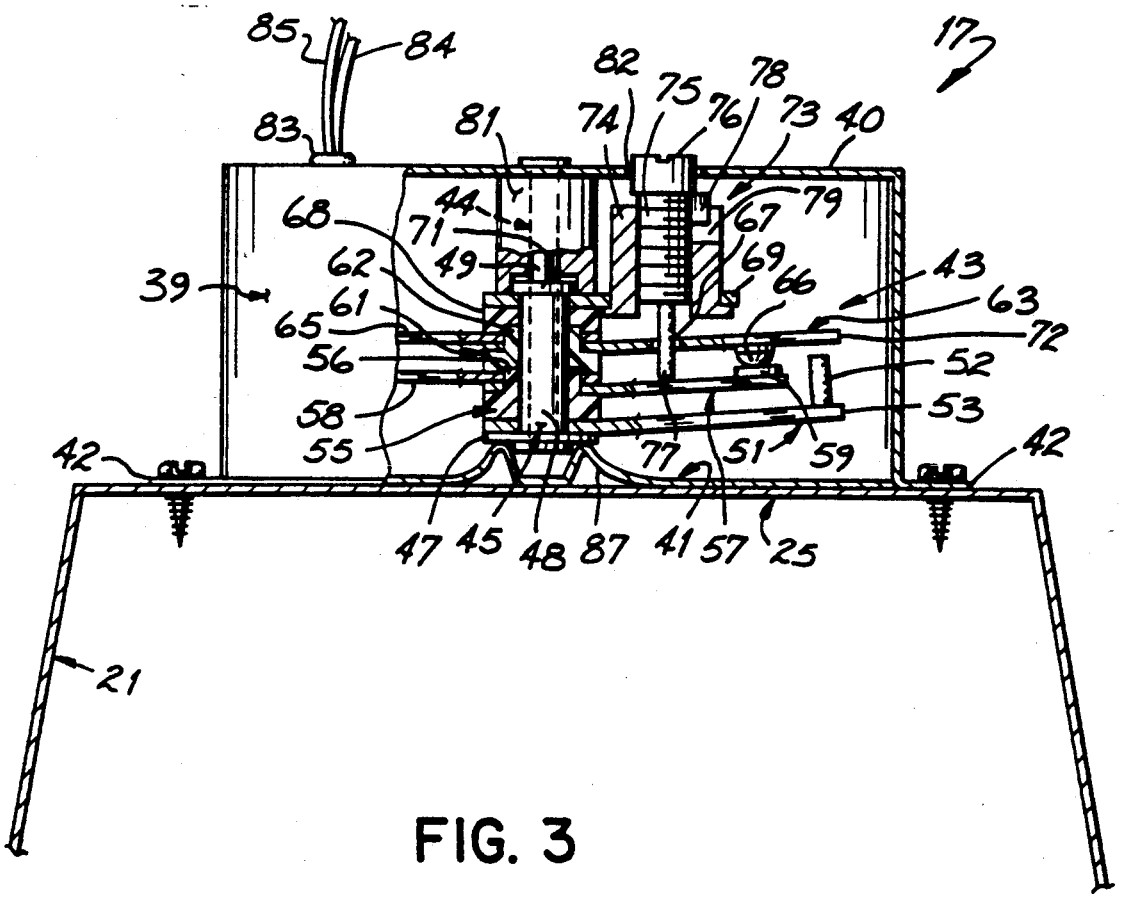
FIG. 3 is a cross-sectional view taken on line 3—3 of FIG. 1 illustrating the adaptor of the present invention with a duty cycling switch attached thereto.

More particularly, referring to FIG. 3, the duty cycling control 17 includes a metal case 39, which has a cupped shaped cover 40, mounted on a metal base plate 41. Case 39 includes a mounting flange 42.

The duty cycling control 17 includes a bimetallic switch 43, mounted on the top cover 40 by a thermally conductive steel rivet 44. The switch 43, includes a steel holding rivet 45, which has a disc shaped head 47 and a hollow steel stem 48. The internal diameter of the stem 48, is about equal to the external diameter of the stem 49 of steel rivet 44 which is inserted through the stem 48 of steel holding rivet 45 to hold the switch 17 to the cover 40 as described below.

The switch includes a bimetal strip 51, mounted on the stem 48 of holding rivet 45, the strip 51 is positioned to rest against the head 47. A non-conductive porcelan post 52 is fixed to the opposite or free end 53 of bimetal strip 51. Non-conductive annular spacer 55 is mounted on stem 48. The spacer 55 includes an upper annular boss 56. Mounted on this annular boss 56 and separated from the metal stem 48 is a first lower contact strip 57 and a lower terminal 58. The contact strip 57 includes a contact or point 59 directed away from the bimetal strip 51. The terminal 58 and the contact strip 57 are both metallic, electrically conductive and in contact with each other providing an electrical path from terminal 58 to the contact 59. The annular boss 56 extends slightly above the first lower terminal 58.

A second annular non-conductive spacer 61, is mounted on stem 48 and nests on the annular boss 56. The annular boss 56 acts to maintain the terminal 58 and contact strip 57 insulated from metal stem 48. The second non-conductive spacer 61 also includes an annular boss 62. An upper contact strip 63 and a second upper terminal 65 are mounted on this annular boss 62. The second contact strip 63 includes a second contact or point 66 directed toward the first point 59. Contact strip 63 further includes a centrally located aperture 67. Both the second contact strip 63 and the terminal 65 are metallic, electrically conductive and in physical contact with each other providing an electrical path from terminal 65 to the second contact 66.

A third annular non-conductive spacer 68 is supported on the stem 48. Spacer 68 nests on annular boss 62. Thus, the annular boss 62 maintains the terminal 65 and the contact strip 62 insulated from the metallic stem 48.

A tab 69 is also mounted on the stem 48. At the end of stem 48 is an annular rivet head 71 which holds tab 69, spacer 68, terminal 65, contact strip 63, spacer 61, terminal 58, contact strip 57, spacer 55 and bimetal strip 51 compressed together. The two contact strips 57 and 63 are based towards each other so that the points 59 and 66 are normally in contact providing a complete electrical circuit between terminal 58 and terminal 65. Bimetal strip 51 is positioned so that upon heating it bends moving posts 52 towards an extended portion 72 of the contact strip 63.

Mounted on tab 69 is an adjusting means or control 73. The adjusting means 73, includes a hollow internally threaded metal sleeve 74, attached to tab 69 and an externally threaded set screw 75 which is threadably received within sleeve 74. The set screw 75 has a slotted head 76 adapted to receive the head of a screw driver. Mounted at the opposite end of the set screw 75 is a non-conducted post 77 which extends through the centrally located aperture 67 in contact strip 563 to a point adjacent to the contact strip 57. Rotation of the set screw in one direction moves the post 77 away from strip 57 allowing strip 57 to bend towards 63 and move them away from post 52. When rotated in the opposite direction it pushes strip 57 away from strip 63 thus changing the distance from post 52 to the extended portion 72 of contact strip 63. This changes the distance the bimetal strip 51 must move to break the contact between the two points 59 and 66 as well as the temperature at which the bimetal switch opens and closes. Set screw 75 further includes a radially extended detent 78 and internally threaded sleeve 74 includes a recessed stop portion 79. Stop portion 79 lies in the path of the extended detent 78, limiting the degree of rotation of the set screw 75.

The switch is mounted to the cover 40 by the steel rivet 44. The rivet passes through the switch 43, spacer 81 and cover 40 and is swagged to hold the switch to the cover through tubular spacer 81 and holds the switch 43 the desired distance from the top of the cover so that the set screw 75 extends slightly above the top cover 40 through aperture 82.

Metal housing 39 further includes a rubber grommeted aperture 83 providing a passage for lead 84 and 85 from terminals 58 and 65.

The lower metal base 41 of the metal housing includes an annular inwardly raised portion 87 which, in the assembled form contacts the head 47, of the mounting rivet 44 and provides improved thermal conduction through the metal casing into the rivet 45 and bimetal strip 51. These combine to provide a means to conduct heat from the base to the bimetal strip whereas air would act as an insulator.

Figure 4:
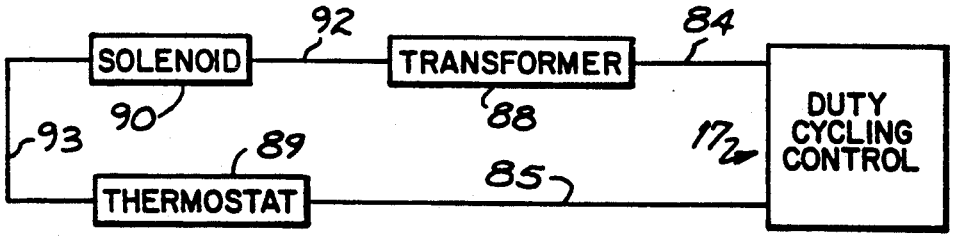
FIG. 4 is a circuit diagram showing the duty cycling switch and thermostat according to the present invention for use with a furnace.

The furnace duty cycling control 17 is wired into the heater solenoid valve circuit (see FIG. 4) in series between the transformer 88 and the thermostat 89. The solenoid 90 is connected directly to a power supply at a first pole (not shown) of transformer 88 by lead 92. A second lead 93 from the solenoid 90 is also connected to the second pole (not shown) of transformer 88 but the connection is made through the thermostat 89 and the duty cycling control 17. Lead 84 from the terminal 58 connects to the second pole of the transformer 88 and lead 85 from terminal 65 connects to the thermostat 89. Thermostat 89 in turn is connected to the solenoid 90 via lead 93. Thus, the solenoid is activated only when the thermostat and the duty cycling switch are closed (i.e., circuit completed).

The duty cycling control 17 is mounted to the metal panel 25 of adaptor 21 by simply bolting or screwing the mounting flange 42 to the panel 25.

To adjust the mounted and wired duty cycling control the thermostat should be turned to a relatively high temperature, i.e., at least about 5 to 10 degrees higher than the room temperature, normally causing the furnace to ignite and burn for an extended period of time. The duty cycling switch should be initially closed.

As designed the burning of the heater heats up the fire box and the heat exchangers, which in turn heat up air exiting from the heater. This air is blown through the furnace and exits through duct 15. The air will pass through adaptor 21 and contacts panel 25. This in turn heats up the base of the duty cycling control and finally the bimetal strip 51 which bends toward the contact strips. Porcelan knob 45 then contacts the extended portion 72 of the contact strip 66 tending to separate the contacts 59 and 66.

The set screw 75 is rotated to effect a break between the contact points 59 and 66 after a burn period which causes the temperature at the thermostat to be 5° to 10° above normal comfort level setting. At this time, the heat exchanger should be fully loaded. The adjustment caused by rotation of the set screw 75 alters the distance which extended portion 72 must be moved to separate the contact strips. Set screw 75 is adjusted until contact is broken. This eliminates the electrical input into the solenoid 90 causing it to close the fuel valve (not shown) cutting off fuel to the heater. While this is occurring, the blower, which is independently activated, continues to blow cold air through the furnace drawing heat from the heat exchanger of the furnace. The temperature of the furnace decreases, so does the temperature of the air exiting through duct 15. In turn the temperature of the panel 25 decreases as well as the base 41 and so does bimetal strip 51 which backs away from the contact strips and the points 59 and 66 will again contact each other. This closes the circuit and re-initiates the burn, thus creating a cycle.

When the temperature of the area being heated is hot enough to satisfy the thermostat, the thermostat will then break the circuit and discontinue the electrical input to solenoid 90 stopping the burn and stopping the cycle.

A bimetal switch can be purchased having a desired temperature range. Preferably a slowly responding switch should be used. The temperature at which the duty cycling switch is reclosed is largely dependent on the bimetal strip. The bimetal strip, which has an operating temperature of 25° F., adequately functions within the range of a typical furnace.

Preferably the adaptor 21 is formed of a heavy gauge metal (20–27 gauge galvinized sheet metal). This acts as a heat sink to which the bimetal strip is responsive. This in effect slows down the operation of the switch and makes it less sensitive to rapid temperature fluctuations. The adaptor is formed from stamped sheet metal and can be formed in sections as desired.

Figure 5:
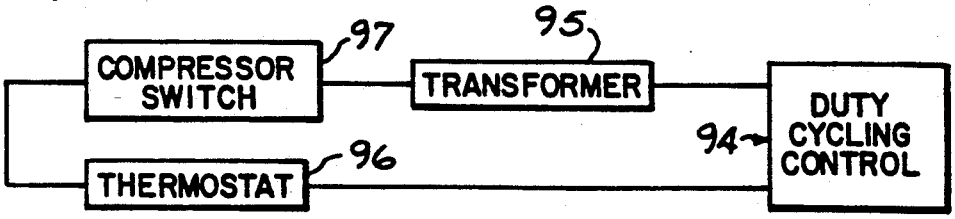
FIG. 5 is a circuit diagram showing the duty cycling switch and thermostat to be used with the present invention with an air conditioning unit.

The present invention also operates in the same manner to effectively control an air conditioner. The wiring diagram for the present invention operable to control an air conditioner is shown in FIG. 5. In this embodiment an air conditioner duty cycling control 94 such as that switch shown in FIG. 5 of U.S. Pat. No. 4,470,267 opens in response to a decrease in temperature (i.e., closes on rise). In the embodiment, the duty cycling control 94 is wired in the air conditioning operating circuit between a pole of transformer 95 and the thermostat 96. The compressor activating switch 97 is then wired between the thermostat 96 and the opposite pole of the transformer 95. The bimetal switch for the air conditioner is designated to operate between 34° and 150° F., therefore, at room temperature, for example about 70° F. or higher the switch will be closed. Again the particular characteristic of the switch can be changed according to desire. However, these ranges of operation are believed to be the best mode currently known to the inventor.

In all other respects the switch for an air conditioning unit is installed in the same manner described for the furnace. It is also installed in the supply side duct 15.

The switch 94, attached to the adaptor 21 is adjusted to limit the duration of compressor operation. This is accomplished by turning the adjusting screw 75 as far as possible clockwise to ensure that the switch will be closed. The air conditioner thermostat 96 is then set at its lowest temperature. The air conditioner should be allowed to operate until the temperature at the thermostat is 2 to 4 degrees below the normal setting at the thermostat. The adjusting screw is then turned counter clockwise until the compressor stops. The screw is then turned clockwise about 1° of rotation to set the temperature at which the compressor is deactivated at a slightly warmer temperature. The thermostat should then be reset to its normal or desired temperature.

By using the adaptor of the present invention, one can attach a duty cycling switch to a heating or air conditioning system in which the plenum is not easily accessible. This will allow the use of the duty cycling control switch in many applications in which it was previously unsuited. Of course, the adaptor can be lengthened so that both the heating and air conditioning duty cycling switch can be employed or alternately two adaptors can be used in two different ducts or two different portions of ducts to facilitate the use of both the air conditioning duty cycling switch and a heating/air-conditioning switch. Other modifications of the present invention may be readily apparent to those skilled in the art.

However, the invention should only be defined by the appended claims wherein we claim:

1. A heating system comprising means to heat air, a duct adapted to transfer air from said means to heat air in an air flow direction;

a duty cycling control switch having means to activate and deactivate said means to heat air responsive to low and high temperatures respectively of said heated air;

said duty cycling control comprising;

an adjustable temperature sensitive switch including a temperature element operable to open and close said switch;

an adaptor mounted to a duct extended from said means to heat air; said adaptor comprising a first cylindrical section and a second cylindrical section and a third middle section connected between said first and second cylindrical sections;

said middle section including a planar portion tangential to said first and second cylindrical sections wherein said duty cycling switch includes a metal base, said switch being operable in response to the temperature of said metal base wherein said switch is mounted to said adaptor with said metal base mounted in direct physical contact with said planar portion.

2. The heating system claimed in claim 1 wherein said third section includes an arcuate portion extending to said planar portion.

3. The heating system claimed in claim 2 including four sloped planar portions extending from said first and second cylindrical sections to corners of said planar portion.

4. The heating system claimed in claim 1 wherein said switch comprises a bimetal switch having two contact means operable in response to a temperature sensitive bimetal element;

said element held in said switch by a metallic rivet, said rivet in physical contact with a base metal plate which is in turn in physical contact with said planar portion.

5. An air conditioning system comprising means to cool a heat exchanger, a duct adapted to transfer air from said heat exchanger in an air flow direction;

a duty cycling control switch having means to activate and deactivate said means to cool said heat exchanger responsive to high and low temperatures respectively of said air;

said duty cycling control switch comprising an adjustable temperature sensitive switch including a temperature sensitive element operable to open and close said switch;

an adaptor mounted to a duct extended from said heat exchanger said adaptor comprising a first cylindrical section and a second cylindrical section and a third middle section connected between said two first and second cylindrical sections;

said middle section including a planar portion tangential to said first and second cylindrical sections wherein said duty cycling switch includes a metal base and switch being operable in response to the temperature of said metal base wherein said switch is mounted to said adaptor with said metal base mounted in direct physical contact with said planar portion.

6. The air conditioning system claimed in claim 5 wherein said third section includes an arcuate portion extending to said planar portion.

7. The air conditioning system claimed in claim 6 including flour sloped planar portions extending from said first and second cylindrical sections to corners of said planar portion.

8. The air conditioning system claimed in claim 5 wherein said switch comprises a bi-metal switch having two contact means operable in response to a temperature sensitive bi-metal element;

said element held in said switch by a metallic rivet and said rivet in physical contact with a base metal plate which is in turn in physical contact with said planar portion.

* * * * *